United States Patent [19]

Demange

[11] Patent Number: 4,981,603

[45] Date of Patent: Jan. 1, 1991

[54] BLENDING METHOD FOR IMPROVED COMPATIBILITY OF DISPERSANTS AND BASIC MAGNESIUM DETERGENTS IN DI PACKAGES

[75] Inventor: Allen L. Demange, Wheaton, Ill.

[73] Assignee: Amoco Corporation, Chicago, Ill.

[21] Appl. No.: 252,577

[22] Filed: Sep. 30, 1988

[51] Int. Cl.[5] ..... C10M 135/10

[52] U.S. Cl. ..... 252/33; 252/49.6; 252/51.5 A

[58] Field of Search ..... 252/33, 49.6, 51.5 A

[56] References Cited

U.S. PATENT DOCUMENTS 4,338,205 7/1982 Wisotsky ..... 252/33

*Primary Examiner*—Olik Chaudhuri
*Assistant Examiner*—Ellen McAvoy
*Attorney, Agent, or Firm*—Matthew R. Hooper; William H. magidson; Ralph C. Medhurst

[57] ABSTRACT

A method for improving the compatibility of oil soluble nitrogen- or ester-containing ashless lube oil dispersants and basic magnesium-containing detergents intended for incorporation in a DI package concentrate which will contain other lube oil additive ingredients, said method comprising the steps of: (1) preparing a mixture comprising (a) the dispersant; (b) the detergent; and (c) a substantially inert solvent; and (2) blending said mixture at a temperature within the range of about 150° to about 380° F. for a period of time sufficient to render the mixture substantially free of haze and sediment, said method being subject to the proviso that the mixture prepared in step (1) be free of other additive ingredients susceptible to thermal decomposition in the blending of step (2).

13 Claims, No Drawings

BLENDING METHOD FOR IMPROVED COMPATIBILITY OF DISPERSANTS AND BASIC MAGNESIUM DETERGENTS IN DI PACKAGES

BACKGROUND OF THE INVENTION

1. Field of the Invention

The present invention relates generally to methods for blending additive components comprising dispersant additives and overbased alkaline earth metal detergent additives into base oil to obtain a lubricating oil additive concentrate ("D/I" package) in which the dispersant and overbased detergent have improved compatibility. More particularly, the invention relates to a method for improving the DI package compatibility of the dispersant and the basic magnesium containing detergents which comprises the steps of: (1) preparing a mixture comprising (a) the dispersant; (b) the detergent; and (c) a substantially inert solvent; and (2) blending said mixture at a temperature within the range of about 150° F.–380° F. for a period of time sufficient to render the mixture substantially free of haze and sediment, said method being subject to the proviso that the mixture prepared in step (1) be free of other additive ingredients susceptible to thermal decomposition in the blending of step (2). The pre-blended mixture of dispersant and detergent, when blended with other DI package additives such as oxidation inhibitors, wear inhibitors, etc., results in a DI package having little or no haze and sediment, both initially and on aging.

2. Discussion of Prior Art

Modern day crankcase lubricants for passenger car as well as heavy duty engines must incorporate a variety of highly specialized additives to meet exacting performance standards promulgated under the American Petroleum Institute's "SF" and "SG" classification for passenger car or under the "CD" and "CE" classification for heavy duty diesel engines.

The additives typically incorporated in a finished lubricant include dispersants, detergents, oxidation inhibitors, wear inhibitors, etc. Dispersants help keep the engine clean by keeping dirt and other particles in suspension in the motor oil to prevent their being deposited or baked onto piston surfaces as "varnish" or onto internal engine surfaces as "sludge". Because dispersing power alone is not sufficient to prevent formation of deposits in the engine, strong detergents capable of cleaning and dissolving deposits on engine surfaces are also required. The detergents normally used for this purpose are the neutral or overbased oil soluble alkaline earth metal sulfonates, phenates and salicylates. If the sulfonates are overbased, so as to contain an excess of basic alkaline earth metal over that necessary to neutralize the sulfonate, the detergent can also act to neutralize the acidic products of combustion which further promotes engine cleanliness.

The conventional manufacture of commercial lubricants incorporating a combination of specialized additives is typically carried out by introducing the additives to the oil in the form of a single additive "package" containing about from 10 to about 80 wt. % active additive ingredients dissolved in hydrocarbon oil or other suitable solvent. To prepare the finished lubricant, the additive package concentrate can be diluted with anywhere from about 3 to about 40 parts by weight of a suitable lubricating oil per part by weight of the additive concentrate.

Although the use of additive package concentrates simplifies handling and shipping of the additives and facilitates solution or dispersion of the additives in the final lubricant blend, a well known problem with such packages is the tendency of certain types of additives to interact with one another. Such interaction is evidenced by the formation of undesirable haze and sediment in the additive package concentrate and can seriously effect the performance and aesthetic qualities of the finished lubricant. This additive interaction is particularly pronounced in packages having a basic magnesium containing detergent and an ashless lube oil dispersant. One way of reducing the interaction of the dispersant and the detergent is to blend other additives with the dispersant before adding the detergent. While this approach is somewhat successful, need presently exists for an improved blending procedure capable of minimizing even further the dispersant detergent interaction.

Robson U.S. Pat. No. 4,502,971 discloses that the problem of interaction between dispersants and basic magnesium detergents can be reduced if the dispersant is prereacted with a basic salt containing an alkali metal such as sodium. The invention described below, however, differs from the Robson '971 patent by providing improved dispersant/detergent compatibility without need for introduction of sodium.

SUMMARY OF THE INVENTION

I have now found that the problem of interaction or incompatibility between ashless amine dispersants and alkaline earth metal sulfonates, phenates or salicylates which occurs when these lubricant additives are blended together with other conventional additives in so called "DI" (i.e., dispersant/inhibitor) additive package concentrates, and which problem manifests itself in the form of unwanted haze and sediment formation, can be alleviated by using a blending method comprising the steps of: (1) preparing a mixture comprising (a) the dispersant; (b) the detergent; and (c) a substantially inert solvent; and (2) blending said mixture at a temperature within the range of about 150° to about 380° F for a period of time sufficient to render the mixture substantially free of haze and sediment, said method being subject to the proviso that the mixture prepared in step (1) be free of other additive ingredients susceptible to thermal decomposition in the blending of step (2). The blending time can be anywhere from about 1 to about 24 hours. The use of blending temperatures at the upper end of the above stated range will generally require a shorter blending time to achieve a haze and sediment free mixture than will temperatures at the lower end of said range. Thus at 160° F. a minimum of 24 hours blending time would be typical while at 350° F. one hour of blending may suffice. As the two component mixing in diluent proceeds, neat haze improves and percent sediment decreases.

While any nitrogen or ester containing ashless dispersant is intended for use in the present invention, examples of such dispersants are those selected from the group consisting of (i) Mannich base dispersants; (ii) succinimide dispersants; (iii) succinate ester-amide dispersants; and (iv) triazole dispersants.

The present invention is also directed to a method for preparing a lubricating oil DI additive package comprising an oil soluble nitrogen or ester containing lube oil ashless dispersant, a basic magnesium containing detergent, and one or more additional additives for imparting oxidation resistance and wear resistance wherein the ashless dispersant and basic magnesium detergent exhibit improved compatability in the package, said method comprising the steps of: (1) preparing a mixture comprising (a) the dispersant; (b) the detergent; and (c) a substantially inert solvent; (2) blending said mixture at a temperature within the range of about 150° F. to about 350° F. for a period of time sufficient to render the mixture substantially free of haze and sediment; said mixture prepared in step (1) being essentially free of other additive ingredients susceptible to thermal decomposition in said blending of step (2); and (3) incorporating said other additives into the blended haze and sediment free mixture. Optionally, the incompatability problem can also be addressed if, instead of the entire amount of dispersant being pre-blended in steps (1) and (2), only a portion thereof is pre-blended, the remainder being introduced in step (3) along with said other additives.

The invention results in DI packages which elicit improved resistance to haze and sediment as measured by ASTM D-2273, and visual inspection.

DETAILED DESCRIPTION

The present invention in its several embodiments involves a technique for preparing concentrated lubricant additive packages comprising an ashless nitrogen or ester containing dispersant; a basic magnesium sulfonate, phenate or salicylate detergent; and various other additives capable of imparting properties comprising wear resistance and oxidation resistance whereby the interaction of the dispersant and detergent resulting in haze and sediment is eliminated or significantly reduced.

Briefly, the technique involves a high temperature blending (at about 150°-380° F.) of a mixture comprising the dispersant and detergent, wherein the blending is carried out for a time sufficient to substantially eliminate haze and sediment in the mixture. Preferably, the high temperature blending of the dispersant and the detergent is carried out in a diluent or solvent, typically mineral lubricating oil or other substantially inert solvent, and in the absence of other additives, especially in the absence of zinc dihydrocarbyl-dithiophosphate ("ZnDTP") wear inhibitors which can decompose when subjected to blending temperatures in excess of about 150° F. for extended periods of time. Other additives typically incorporated in DI packages may also exhibit temperature instability similar to the ZnDTP inhibitors and should as well be excluded from the high temperature blending regimen prescribed herein for the dispersant and detergent. Of course, DI additives which are not sensitive to high temperature blending conditions can be included with the dispersant and detergent during the high temperature blending procedure, if desired; however the reduction in haze and sediment may not be as pronounced as when the detergent and dispersant are mixed together in the absence of other additives.

Following the high temperature blending step which, depending upon the temperature used, can last anywhere from about 1 to about 24 hours or more, the blended mixture comprising the dispersant and magnesium detergent is combined with the remaining DI additive components such as the ZnDTP inhibitor and any other additives not stable enough to be present during the high temperature blending step. The full package is then subjected to additional low temperature blending (≦150° F.) for a time only so long as is necessary to provide a uniform blend of the additive ingredients, typically about an hour.

The term "blending" as used in the present invention is well understood in the lubricant additive industry and is synonymous with mixing or stirring. A person of ordinary skill in the art understands what it means to "blend" a DI package and will also be familiar with the range of conventional equipment used to carry out such blending.

The term "other additives" or "other DI additives" should be understood to encompass the full range of conventional DI additive components. Insofar as such other additives do not constitute the focus of the invention, detailed descriptions of the many species of additives is unnecessary here. The selection of additives for incorporation in a DI package is a matter of ordinary skill in the art.

As indicated above, the high temperature blending of the ashless dispersant and the basic magnesium detergent, while preferably conducted in the absence of other additives, can, if desired, be carried out in the presence of other DI additives capable of withstanding the severity of the high temperature blending step. Determining which additives can withstand high temperature blending with the dispersant and detergent is within the level of ordinary skill in the art.

The high temperature blending step as prescribed in the present invention can be carried out such that all of the dispersant intended for the DI package is pre-blended with the detergent, or such that only a portion of the dispersant is pre-blended with the detergent, the remainder being added with the other DI additives following completion of the high temperature blending step.

The Nitrogen or Ester Containing Ashless Dispersant

Any nitrogen or ester containing ashless lubricating oil dispersant can be used in the present invention. Examples of nitrogen containing ashless dispersants include (i) Mannich base dispersants; (ii) succinimide dispersants; (iii) succinate ester-amide dispersants, and (iv) triazole dispersants.

The Mannich base dispersants suitable for use in the present invention result from the condensation under Mannich reaction conditions of a hydroxyaromatic compound, an aldehyde yielding reagent, and an amine. Preferably, the reactants are: (a) a high molecular weight alkyl-substituted hydroxyaromatic compound whose alkyl substituent has a number average molecular weight of about 600 to 100,000, preferably a polyalkylphenol whose polyalkyl substituent is derived from 1-mono-olefin polymers (preferably polybutene) having an Mn of about 850–2500; (b) an amine containing at least one primary or secondary amine group, preferably a polyalkylene polyamine, and (c) an aldehyde, preferably formaldehyde, paraformaldehyde or formalin. Representative examples of Mannich base dispersants are shown in Piasek et al. U.S. Pat. Nos. 3,697,574; 3,703,536; 3,704,308; 3,751,365; 3,756,953; 3,798,165; 3,798,247; and 3,803,039, which are incorporated by reference. For a more complete understanding of the Mannich reaction see "Organic Reactions," Vol. 1, pages 303 to 341 (1942) published by John Wiley & Sons, Inc.

For purposes of the present invention, the term "Mannich base dispersant should be understood in its broadest sense to encompass reaction products of a hydrocarbyl substituted phenol, wherein the hydrocarbyl group is oil soluble, or an oxidized olefinic polymer, with aliphatic aldehydes containing from 1 to 7 carbon atoms, and amines. Examples of these types of reaction products are described in the following U.S. Pat. Nos. which are incorporated herein by reference:

| | | |
|---|---|---|
| 2,459,112 | 3,448,047 | 3,634,515 |
| 2,962,442 | 3,454,497 | 3,649,229 |
| 2,984,550 | 3,459,661 | 3,697,574 |
| 3,036,003 | 3,493,520 | 3,725,227 |
| 3,166,516 | 3,539,633 | 3,725,480 |
| 3,236,770 | 3,558,743 | 3,726,882 |
| 3,368,972 | 3,586,629 | 3,872,019 |
| 3,413,347 | 3,591,598 | 3,980,569 |
| 3,442,808 | 3,600,372 | 4,011,380 |
| | | 4,131,553 |

The succinimide dispersants suitable for use in the present invention are disclosed in numerous references and have become exceedingly well known in the art. Certain fundamental types of succinimides and the related materials encompassed by the term "succinimide" are taught in U.S. Pat. Nos. 3,172,892; 3,219,666; and 3,272,746, incorporated herein by reference which contain many examples of their preparation. The term "succinimide" is understood in the art to include many of the amide, imide and amidine species which are also produced by the reactions employed in the preparation of the succinimide material. The predominant product, however, is a succinimide, the most prevalent commercial species of which is the reaction product of an alkenyl substituted succinimic acid or anhydride with a nitrogen containing compound. The term "succinimide dispersant" for purposes of the present should be understood to broadly encompass carboxylic polyamine dispersants which are the reaction products of an acylating agent such as a monocarboxylic acid, dicarboxylic acid, polycarboxylic acid, or derivatives thereof with compounds which contain amine groups. These products are described in many patents including the following U.S. Patents which are incorporated by reference herein:

| | | |
|---|---|---|
| 3,163,603 | 3,381,022 | 3,541,012 |
| 3,184,474 | 3,399,141 | 3,542,678 |
| 3,215,707 | 3,415,750 | 3,574,101 |
| 3,271,310 | 3,433,744 | 3,576,743 |
| 3,281,357 | 3,444,170 | 3,630,904 |
| 3,306,908 | 3,448,048 | 3,632,510 |
| 3,311,558 | 3,448,049 | 3,632,511 |
| 3,316,177 | 3,341,933 | 3,697,428 |
| 3,340,281 | 3,454,607 | 3,725,441 |
| 3,200,107 | 3,367,943 | 3,502,677 |
| 3,216,936 | 3,373,111 | 3,513,093 |
| 3,256,185 | 3,442,808 | 3,539,633 |
| 3,278,550 | 3,455,831 | 3,573,010 |
| 3,312,619 | 3,455,832 | 3,591,598 |
| 3,366,569 | 3,493,520 | 3,600,372 |
| 3,341,542 | 3,467,668 | 3,649,659 |
| 3,346,493 | 3,522,179 | 3,702,757 |

A further class of ashless nitrogen containing dispersants suitable in the present invention are the so called "succinate ester-amide" dispersants. The term "succinate ester-amide dispersants" as used herein is intended to encompass the reaction product of a long-chain aliphatic hydrocarbyl substituted succinic acid or anhydride with an N-substituted hydroxyalkyl amine. Representative patents disclosing this type of ashless dispersant are Malec U.S. Pat. No. 4,426,305; and Le Seur U.S. Pat. Nos. 3,219,666, 3,640,904 and 3,282,955, and European Patent No. 090269, Application No. 83301723.9, all of which are incorporated by reference.

Another type of ashless nitrogen containing dispersant that can be used in the present invention is the triazole dispersant obtained by reacting about one equivalent of polyalkenyl succinic anhydride with about 1.5 to about 2.2 moles of aminoguanidine bicarbonate at a temperature of about 155° C. to about 200° C. A preferred triazole is obtained by reacting polybutenyl succinic anhydride, derived from polybutene having a number average molecular weight of from about 250 to about 5,000, with aminoguanidine bicarbonate at a temperature of about 170° C. to about 190° C. in a ratio of about 1.7 to 2 moles of aminoguanidine per equivalent of polybutenyl succinic anhydride.

Another class of nitrogen containing dispersant which may be used in the present invention includes those wherein a polyamine is attached directly to a long chain aliphatic hydrocarbon group (i.e., typically polybutyl group as shown in U.S. Pat. Nos. 3,275,554 and 3,565,804).

A further class of nitrogen or ester containing dispersants are those which also have viscosity index improving properties such as:

(a) polymers comprised of $C_4$ to $C_{24}$ unsaturated esters of vinyl alcohol or $C_3$ to $C_{10}$ unsaturated mono- or di-carboxylic acid with unsaturated nitrogen containing monomers having 4 to 20 carbons;

(b) polymers of $C_2$ to $C_{20}$ olefin with unsaturated $C_3$ to $C_{10}$ mono- or di-carboxylic acid neutralized with amine, hydroxy amine or alcohols;

(c) polymers of ethylene with a $C_3$ to $C_{20}$ olefin further reacted either by grafting $C_4$ to $C_{20}$ unsaturated nitrogen containing monomers thereon or by grafting an unsaturated acid onto the polymer backbone and then reacting said carboxylic acid groups with amine, hydroxy amine or alcohol.

Alternatively, the ashless dispersant used in this invention may be an ester derived from the polyalkenyl succinic anhydride ("PIBSA") intermediate used to prepare the succinimide, succinate ester and triazole dispersants described above. The ester can be obtained by reaction of the PIBSA with hydroxy compounds such as monohydric and polyhydric alcohols or aromatic compounds such as phenols and naphthols. The polyhydric alcohols can contain from 2 to 10 hydroxy radicals, for example, ethylene glycol, diethylene glycol, triethylene glycol, tetraethylene glycol, dipropylene glycol, and other alkylene glycols in which the alkylene radical contains from 2 to about 8 carbon atoms. Other useful polyhydric alcohols include glycerol, mono-oleate of glycerol, monostearate of glycerol, monomethyl ether of glycerol, pentaerythritol.

The ester dispersant may also be derived from unsaturated alcohols such as allyl alcohol, cinnamyl alcohol, propargyl alcohol, 1-cyclohexane-3-ol, and oleyl alcohol.

The ester dispersant may be di-esters of succinic acids or acidic esters, i.e., partially esterified succinic acids; as well as partially esterified polyhydric alcohols or phenols, i.e., esters having free alcohols or phenolic hydroxyl radicals. Mixtures of the above illustrated esters likewise are contemplated within the scope of this invention.

The nitrogen or ester containing ashless dispersants contemplated for use in this invention include the various categories disclosed in U.S. Patent 4,502,971 the teachings of which are incorporated herein by reference.

In the high temperature blending method of the present invention, the ashless nitrogen or ester-containing oil soluble dispersant is blended with a basic magnesium containing detergent. The substrate for the detergent can be a sulfonate, phenate or salicylate. Neutral and overbased varieties of these detergents are exceedingly well known in the art.

The basic, highly basic or overbased magnesium detergents can be prepared in a conventional manner, for example, by heating a mixture comprising an oil-soluble alkyl, aryl, or alkaryl sulfonic acid with an excess of magnesium oxide above that required for complete neutralization of the sulfonic acid and thereafter forming a dispersed carbonate complex by reacting the excess metal with carbon dioxide to provide the desired level of overbasing.

Sulfonic acids used to prepare the basic detergents are typically obtained by the sulfonation of alkyl substituted aromatic hydrocarbons such as those obtained from the fractionation of petroleum by distillation and/or extraction or by the alkylation of aromatic hydrocarbons as for example those obtained by alkylating benzene, toluene, xylene, naphthalene, diphenyl and the halogen derivatives such as chlorobenzene, chloro-toluene and chloronaphthalene. The alkylation may be carried out in the presence of a catalyst with alkylating agents having from 3 to more than 30 carbon atoms such as for example haloparaffins, olefins that may be obtained by dehydrogenation of paraffins, polyolefins as for example polymers from ethylene or propylene. The sulfonates usually contain from 9 to 70 or more carbon atoms, preferably from 16 to 50 carbon atoms per alkyl-substituted aromatic moiety.

The magnesium compounds which may be used in neutralizing these sulfonic acids to provide the sulphonates include the oxides and hydroxides, alkoxides, carbonates, carboxylate, sulphide, hydrosulfide, nitrate, borates and ethers of magnesium. As noted, the magnesium compound is used in excess of that required for complete neutralization of the sulfonic acids.

Polyvalent magnesium alkyl salicylate and naphthenate materials are additional known additives for lubricating oil compositions to improve their high temperature performance and to counteract deposition of carbonaceous matter on pistons (U.S. Pat. No. 2,744,069). An increase in reserve basicity of the polyvalent metal alkyl salicylates and naphthenates can be realized by utilizing magnesium salts of mixtures of $C_8$–$C_{26}$ alkyl salicylates and phenates (see U.S. Pat. No. 2,744,069) or salts of alkyl salicyclic acids, said acids obtained from the alkylation of phenols followed by phenation, carboxylation and hydrolysis (U.S. Pat. No. 3,704,315) which could then be converted into highly basic salts by techniques generally known and used for such conversion. Included with the useful polyvalent metal salicylate and naphthenate materials are the methylene and sulfur bridged materials which are readily derived from alkyl substituted salicyclic or naphthenic acids or mixtures of either or both the alkyl substituted phenols. Basic sulfurized salicylates and a method for their preparation is shown in U.S. Pat. No. 3,595,791.

Alternatively the magnesium detergent may be a sulfurized magnesium phenate which can be considered the magnesium salt of a phenol sulfide which thus refers to a salt, whether neutral or basic, of a compound typified by the general formula:

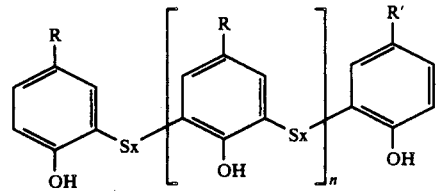

wherein x and n are integers from 1 to 4, and the average number of carbon atoms in all of the R groups is at least about 9 in order to ensure adequate solubility in oil. The individual R groups may each contain from 5 to 40, preferably 8 to 20, carbon atoms. The metal salt is prepared by reacting an alkyl phenol sulphide with a sufficient quantity of alkaline earth metal material to impart the desired alkalinity to the sulfurized magnesium phenate.

The sulfurized alkyl phenol is converted by reaction with a magnesium containing material including oxides, hydroxides and complexes in an amount sufficient to neutralize said phenol and, if desired, to overbase the product to a desired alkalinity by procedures well known in the art. Typical is a process of neutralization utilizing a solution of metal in a glycol ether.

The neutral or normal sulfurized alkaline earth phenates are those in which the ratio of magnesium to phenol nucleus is 1:2. The "overbased" or "basic" sulphurized alkaline earth metal phenates are sulphurized metal phenates wherein the ratio of basic metal compound to phenol is greater than that of stoichiometry, e.g., basic sulphurized magnesium dodecyl phenate has a metal content up to and greater than 100% in excess of the metal present in the corresponding normal sulphurized metal phenates wherein the excess metal is suspended in oil-soluble or dispersible form (as by reaction with $CO_2$)

The alkaline earth metal sulfonate, phenate and salicylate detergents used in the present invention can have total base numbers (TBNs) as determined by ASTM D-2896 of up to about 400 or more.

The high temperature blending prescribed in the present invention is equally applicable to normal or neutral salts of magnesium detergents as well as to neutral or basic calcium or barium sulfonates, salicylates and phenates. Thus where haze and sediment results from interaction of ashless dispersants with calcium or barium containing detergents, the process of the invention can be used to overcome the haze and sediment caused by such interaction.

In accordance with the present invention the ashless nitrogen or ester containing dispersant and the magnesium detergent intended for incorporation into a DI package concentrate containing other conventional additives are initially combined and blended at a temperature of about 150°–380° F., preferably about 190°–250° F. for a time of about 1 to about 24 hours. The combination of temperature and blending time selected should be such as will cause disappearance of haze and sediment which will be initially evident shortly after the dispersant and detergent are combined and blending is begun, but will gradually disappear as the high temperature blending proceeds. At lower temperatures within the above prescribed range, i.e., about 150 to about 250° F. blending times of about 10–30 hours would be typical, while at the higher temperatures, i.e., 250°–380° F. blending times of 1 to about 10 hours will generally suffice. The dispersant and detergent are preferably heated individually to the desired blending temperature, following which the detergent is added to the dispersant (or vice versa) and high temperature blending thereof carried out.

Other additives can be present during the high temperature blending of the detergent and dispersant provided the additives are stable enough to withstand the blending conditions. For example, ZnDTP oxidation/-wear inhibitors generally should be excluded from the high temperature blending because these compounds are likely to decompose.

To prepare the final package containing the full slate of DI additives, any remaining additives excluded from the high temperature blending step can be added to the dispersant-detergent blend. An additional brief period of blending should be carried out at no greater than about 150° F. and only so long as necessary to provide a uniform blend. One to three hours is generally adequate.

It should be pointed out that, if other temperature stable additives are included in the dispersant detergent high temperature blending step, it may be necessary to use longer blending times and higher temperatures to achieve a substantially haze free/sediment free mixture.

The following examples are intended to illustrate but not limit the invention.

EXAMPLE 1

This example illustrates for comparative purposes, preparation of a DI package having haze and sediment. The dispersant was a polybutenyl succinimide obtained by reacting PIBSA (derived from polybutene having $M_n$ molecular weight of about 1850–2500) with tetraethylene pentaamine and post treating with boron. The detergent was an overbased (400 TBN) magnesium alkylbenzene sulfonate. The remaining DI additives included an overbased calcium sulfurized phenate, a high base calcium sulfonate, zinc dihydrocarbyldithiophosphates, an arylamine antioxidant, and SX-5 oil. All of the above components except the magnesium sulfonate were mixed for one hour at 160° F., the resulting mixture being bright and clear, and having an ASTM D-2273 sediment of 0.02%. The magnesium sulfonate detergent was then added and the resulting mixture blended for 6 hours at 160° F. The resultant blend was hazy and had ASTM D-2273 sediment of 1.7% dense haze. The blend when stored in a centrifuge tube at 160° F. showed 40% medium haze separation after two weeks.

EXAMPLE 2

This example, utilizing the same DI package ingredients as used in Example 1, above, shows that a high temperature blending of the succinimide dispersant and the magnesium sulfonate detergent in the presence of the other additives (except the zinc dithiophosphate compound) significantly improves the appearance of the DI package although on neat aging some haze may still develop. Specifically, the succinimide dispersant, the calcium sulfurized phenate, the high base calcium sulfonate and SX-5 oil were mixed for 1 hour at 160° F. The magnesium sulfonate detergent was then added and the mixture blended at 200° F. for about 24 hours to obtain a haze and sediment free mixture. The zinc dithiophosphate and the arylamine inhibitors were then added and the mixture blended for an additional 16 hours at 160° F. The resulting DI package was clear and had ASTM 2273 sediment of 0.02%. After storage for 1 week in a centrifuge tube at 160° F. the DI package had 100% light haze. At 8 weeks it had 98% light haze 12% medium haze. These haze levels were measured by visual inspection.

EXAMPLE 3

This example utilizes the same additives used in Example 1. However, in this example the succinimide dispersant and the magnesium sulfonate detergent were blended together, in the absence of other additives, for 24 hours at 200° F. During the first 6 hours of the 24 hour blend period the dispersant/detergent mixture was hazy, but the haze gradually disappeared during the remaining 18 hours of blending until, at 24 hours, the mixture was clear with ASTM D-2273 sediment of 0.01%. The other additives were added followed with 1 hour of mixing at 160° F. The package was bright and clear and remained that way even after 8 weeks of storage at 160° F.

EXAMPLE 4

Example 3 was repeated except that the dispersant detergent mixture (free of other additives) was high temperature blended at 350° F. for four hours. After 15 minutes of the four hour period the dispersant detergent mixture went from hazy to clear. The other components were then added followed by one hour of blending at 160° F. The finished product DI package was bright and clear and remained that way after one week of storage at 160° F.

This Example shows that the amount of blending time required to cause the haze and sediment in the dispersant/detergent mixture to disappear is less if higher temperatures are used.

EXAMPLE 5

(a) All of the components described in Example 1 were blended together for 1 hour at 160°. A centrifuged bottom layer of 4% dense haze (ASTM D-2273) had the following analysis.

TABLE A

| TBN | 584 mg KOH/gm |
|---|---|
| Mg, % | 10.5 |
| S, % | 2.2 |
| B, % | 0.29 |
| N, % | 0.23 |

(b) In a separate experiment, 56.8 grams of the succinimide dispersant and 8.88 grams of the magnesium sulfonate detergent were mixed at 160° F. for 10 minutes. A centrifuged bottom layer of 2% dense haze had the following analysis:

TABLE B

| TBN | 421 mg KOH/gm |
|---|---|
| Mg, % | 9.40 |
| S, % | 1.14 |
| B, % | 0.21 |
| N, % | 0.31 |

As can be seen from a comparison of Tables A and B, the composition of the dense haze obtained in part (a) of this example is essentially the same as that obtained in part (b), leading one to conclude that the dispersant and detergent should not be mixed together directly. It is therefore quite surprising and unexpected that, in accordance with the present invention, if the dispersant and detergent are mixed at higher temperatures for a sufficient period of time (see Examples 3 and 4) a haze and sediment free blend results.

EXAMPLE 6

The dispersant detergent mixture of Example 5(b) was blended at 160° F. for 24 hours while continuously monitoring haze and sediment in the mixture. The results are shown in Table C below:

TABLE C

| Blend Time | Neat Appearance | Sediment D-2273 |
|---|---|---|
| 15 mins. | hazy | 3½% haze + 75% hazy |
| 1 hr. | hazy | 5% haze + 60% hazy |
| 3 hrs. | hazy | 5½% haze + clear |
| 6 hrs. | hazy | 6% haze + clear |
| 24 hrs. | clear | 0.01% sediment + clear |

The data in Table C illustrate that even at temperatures as low as 160° F. the dispersant detergent mixture will turn clear if mixed long enough.

I claim:

1. A method of improving the compatibility of oil soluble nitrogen- or ester-containing ashless lube oil dispersants and basic magnesium-containing detergents intended for incorporated in a DI package concentrate which will contain other lube oil additive ingredients, said method comprising the steps of: (1) preparing a mixture comprising (a) the dispersant; (b) the detergent; and (c) a substantially inert solvent; and (2) blending said mixture at a temperature within the range of about 150° to about 380° F. for a period of time sufficient to render the mixture substantially free of haze and sediment, said method being subject to the proviso that the mixture prepared in step (1) be free of other additive ingredients susceptible to thermal decomposition in the blending of step (2) wherein said dispersant comprises a succinimide and said detergent comprises an overbased magnesium alkylbenzene sulfonate.

2. The method of claim 1 wherein the magnesium detergent is an overbased magnesium sulfonate having a TBN of about 150 to about 500.

3. The method of claim 1 wherein the ashless dispersant is a borated or non-borated succinimide dispersant.

4. The method of claim 1 wherein the amount of ashless dispersant present in the mixture prepared in step (1) is less than the total amount of said ashless dispersant intended for incorporation in said DI package.

5. The method of claim 1 wherein the blending of step (2) is carried out at a temperature of about 190° F. to about 250° F. for a period of about 5 to about 25 hours.

6. The method of claim 1 wherein the mixture prepared in step (1) consists essentially of said dispersant, detergent and solvent.

7. A method for preparing a lubricating oil DI additive package comprising an oil soluble nitrogen or ester containing lube oil ashless dispersant, a basic magnesium containing detergent, and one or more additional additives for imparting oxidation resistance and wear resistance wherein the ashless dispersant and basic magnesium detergent exhibit improved compatibility in the package, said method comprising the steps of: (1) preparing a mixture comprising (a) the dispersant: (b) the detergent; and (c) a substantially inert solvent; (2) blending said mixture at a temperature within the range of about 150° to about 350° F. for a period of time sufficient to render the mixture substantially free of haze and sediment; said mixture prepared in step (1) being essentially free of other additive ingredients susceptible to thermal decomposition in said blending of step (2); and (3) incorporating said other additives into the blended haze- and sediment-free mixture wherein said dispersant comprises a succinimide and said detergent comprises an overbased magnesium alkylbenzene sulfonate.

8. The method of claim 7 wherein the magnesium detergent is an overbased magnesium sulfonate having a TBN of about 150 to about 500.

9. The method of claim 8 wherein the ashless dispersant is a borated or non-borated succinimide dispersant.

10. The method of claim 1 wherein the amount of ashless dispersant present in the mixture prepared in step (1) is less than the total amount of said ashless dispersant intended for incorporation in said DI package.

11. The method of claim 7 wherein the blending of step (2) is carried out at a temperature of about 190° F. to about 250° F. for a period of about 5 to about 25 hours.

12. The method of claim 7 wherein the mixture prepared in step (1) consists essentially of the dispersant, the detergent and the solvent.

13. A method for improving the compatibility of oil soluble nitrogen or ester containing lube oil ashless dispersants and basic magnesium sulfonate detergents in DI packages incorporating these materials plus other additives imparting properties comprising oxidation resistance and wear resistance, said method comprising: (1) preparing a mixture in which there is measurable haze and sediment, said mixture consisting essentially of (a) a magnesium sulfonate detergent having a TBN of about 150 to about 500; and (b) a borated or non-borated ashless dispersant consisting of a succinimide dispersant; and (c) substantially inert solvent; and (2) blending said mixture at a temperature of about 150° F. to about 380° F. for a period of time sufficient to render the mixture substantially free of said haze and sedient.

* * * * *